US009573076B1

(12) United States Patent
Vaught

(10) Patent No.: US 9,573,076 B1
(45) Date of Patent: Feb. 21, 2017

(54) ELECTRONIC/MECHANICAL DOG AGILITY JUMP

(71) Applicant: Christine M. Vaught, Washoe Valley, NV (US)

(72) Inventor: Christine M. Vaught, Washoe Valley, NV (US)

( * ) Notice: Subject to any disclaimer, the term of this patent is extended or adjusted under 35 U.S.C. 154(b) by 0 days.

(21) Appl. No.: 14/229,802

(22) Filed: Mar. 28, 2014

Related U.S. Application Data

(60) Provisional application No. 61/808,737, filed on Apr. 5, 2013.

(51) Int. Cl.
*A63K 3/00* (2006.01)
*A63K 3/04* (2006.01)

(52) U.S. Cl.
CPC ..... *A63K 3/04* (2013.01)

(58) Field of Classification Search
CPC ..... A63K 3/04; A63K 3/043; A63K 3/046
USPC ..... 119/705
See application file for complete search history.

(56) References Cited

U.S. PATENT DOCUMENTS

| | | | | |
|---|---|---|---|---|
| 1,737,108 | A | 11/1929 | Craig | |
| 3,637,204 | A | 1/1972 | Dawson | |
| 3,795,396 | A | 3/1974 | Kropelnitski | |
| 4,749,187 | A | 6/1988 | Dellinger | |
| 5,496,204 | A | 3/1996 | Brown et al. | |
| 5,913,283 | A | 6/1999 | Coury | |
| 5,924,386 | A | 7/1999 | Lewis | |
| 6,263,835 | B1 | 7/2001 | Santi | |
| 6,715,448 | B1 * | 4/2004 | McComb | 119/705 |
| 6,726,604 | B2 | 4/2004 | Verdun | |
| 6,976,452 | B1 * | 12/2005 | Godsil | A63K 3/04 119/705 |
| 8,057,361 | B2 | 11/2011 | McBride | |
| 2009/0275444 | A1 * | 11/2009 | Derry | 482/17 |
| 2013/0174794 | A1 * | 7/2013 | Casiello | 119/705 |

FOREIGN PATENT DOCUMENTS

| | | | |
|---|---|---|---|
| CH | 703131 | A1 * | 11/2011 |
| DE | EP 0036033 | B1 * | 6/1983 |
| WO | 2011110980 | | 9/2011 |

OTHER PUBLICATIONS

Field, M. T. (Apr. 2011). Pole Vault Eletronic Standard 2012. Retrieved Jun. 15, 2015, from Mondotrack: http://www.mondotrack.com/Pole_Vault_Electronic_Standard_2012.cfm?id_categoria=23&id_classe=3.*

* cited by examiner

*Primary Examiner* — Kristen C Hayes
*Assistant Examiner* — Aaron Rodziwicz
(74) *Attorney, Agent, or Firm* — Quickpatents, LLC; Kevin Prince

(57) ABSTRACT

An adjustable vault apparatus for use on a ground surface includes a base and a pair of linear actuators mounted vertically at opposing sides thereof. Each linear actuator is adapted to move a bar support thereof vertically between a lowered position and a raised position. The bar supports are mutually opposing and adapted to support one end of an elongated jump bar at a bar trough thereof, by gravity. Each linear actuator moves the bar support in accordance to a control circuit electrically connected with each linear actuator and a power source. A control signal received by the control circuit, either wirelessly or by wired connection, causes the control circuit to actuate each linear actuator to either raise or lower each bar support in unison, and the jump bar.

20 Claims, 3 Drawing Sheets

ELECTRONIC/MECHANICAL DOG AGILITY JUMP

CROSS-REFERENCE TO RELATED APPLICATIONS

This application claims the benefit of U.S. Provisional Patent Application 61/808,737, filed on Apr. 5, 2013, and incorporated herein by reference.

STATEMENT REGARDING FEDERALLY SPONSORED RESEARCH AND DEVELOPMENT

Not Applicable.

FIELD OF THE INVENTION

This invention relates to animal husbandry, and more particularly to an animal competitive vault apparatus.

DISCUSSION OF RELATED ART

In animal competitions having agility jumping as one of the obstacles in an obstacle course, for example, the height of the jumps must be routinely adjusted for animals of different sizes or classes, or for different types of animals or competitions. As such, it is a time consuming process to have one or more workers run to each jump to adjust the jump bar height.

Several prior art devices teach motor-driven obstacles, such as U.S. Pat. No. 6,715,448 to McComb on Apr. 6, 2004. McComb's mechanism for raising and lowering an equestrian barrier post is fixed at a top end of each of two vertically-oriented standards, and includes a cable fixed to the barrier post from above. Such a device results in a top-heavy standard that is unstable if struck. Further, the cables of such devices, since exposed, are subject to impact and damage by horses or other animals jumping over the barrier post. In such an apparatus it is easy for the two opposing cables to become unsynchronized if one of the cables is strained by an animal, or otherwise.

U.S. Pat. No. 6,263,835 to Santi on Jul. 24, 2001 also includes a motor at the top of each standard, and would likely be unstable in the same manner as the McComb device but for the multiple jumps affixed with the same base rails. The Santi device is not well suited to single jump configurations.

U.S. Pat. No. 3,637,204 to Dawson on Jan. 25, 1972, teaches a pole vault crossbar apparatus that allows for motorized height adjustment of the crossbar. Such a device is belt-driven, and as such belt slips can cause the height of two crossbar support pegs to become misaligned. Further, the motor in such a device is exposed to the elements, making such a device potentially dangerous when used in inclement weather.

Therefore, there is a need for a device that provides a remotely adjustable agility jump for animals. Such a needed device would provide for either wired or wireless control of the height of the jump bar or bars, and would provide a stable base that is not easily tipped by an errant animal or other accident. Such a needed device would provide electro-mechanical adjustment of the jump bar height remotely, as well as manual adjustment of the width between linear actuators for accommodating jump bars of varying sizes. The alignment of each side of the crossbar of such a device would not easily become misaligned. Such a needed device would be relatively easy to manufacture, transport and use, and would be at least water resistant. The present invention accomplishes these objectives.

SUMMARY OF THE INVENTION

The present device is an adjustable vault apparatus for use on a ground surface, such as an animal competition track or the like. A base has a width and a length for resting on the ground surface in a substantially horizontal orientation.

A pair of linear actuators are mounted in a substantially vertical orientation with the base at opposing sides thereof. Each linear actuator is adapted to move a bar support thereof vertically between a lowered position and a raised position. The bar supports are mutually opposing and adapted to support one end of an elongated jump bar at a bar trough thereof, by gravity. In one embodiment, each bar support is adapted to support the ends of two jump bars in parallel, each at two different heights above the ground surface.

Each linear actuator moves the bar support in accordance to a control circuit electrically connected with each linear actuator and a power source, such as an AC adapter or line voltage or a battery, for example. A control signal received by the control circuit causes the control circuit to actuate each linear actuator to either raise or lower each bar support in unison, and the at least one jump bar.

Preferably each linear actuator includes a motor enclosed in a motor enclosure and connected with a lower end of a threaded shaft that extends upwardly through a shaft enclosure. The shaft enclosure includes a longitudinal slot traversed by the bar support. A proximal end of the bar support includes a threaded portion rotationally engaged with the threaded shaft. A distal portion of the bar support terminates at the bar trough. The longitudinal slot thereby rotationally fixes the bar support within the linear actuator, while allowing the bar support to be raised or lowered in accordance with the direction that the motor spins the threaded shaft. A top end of the shaft enclosure may include a shaft cap having a central aperture through which an upper end of the threaded shaft is rotationally captured.

In one embodiment, a first motor enclosure includes a battery as the power source, and the control circuit. In such an embodiment, the control circuit of the first motor enclosure drives the motors of both motor enclosures. The first motor enclosure may include a pair of control connectors, whereby an external control line may be connected with each of the control connectors to direct the circuit to power each motor to either raise or lower the at least one bar support. In an alternate embodiment, the control circuit of at least the first motor enclosure includes a wireless receiver, whereby a wireless control signal may be received by the wireless receiver and conveyed to the circuit for powering each linear actuator to either raise or lower the at least one bar support. In an alternate embodiment of the invention, each motor enclosure includes its own battery or other power source, and its own circuit, whereby each linear actuator operates independently to receive the control signal to power the linear actuator to either raise or lower the at least one bar support.

The present invention is a device that provides a remotely adjustable agility jump for animals. The present device allows for either wired or wireless control of the height of one or more jump bars, and provides a stable base that is not easily tipped by an errant animal or other accident. The present invention provides electro-mechanical adjustment of the jump bar height remotely, as well as manual adjustment of the width between linear actuators for accommodating jump bars of varying sizes. Each side of the jump bar of the present device is not easily misaligned. The present device is relatively easy to manufacture, transport, set-up and use, and can be made to be water resistant or water impervious. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
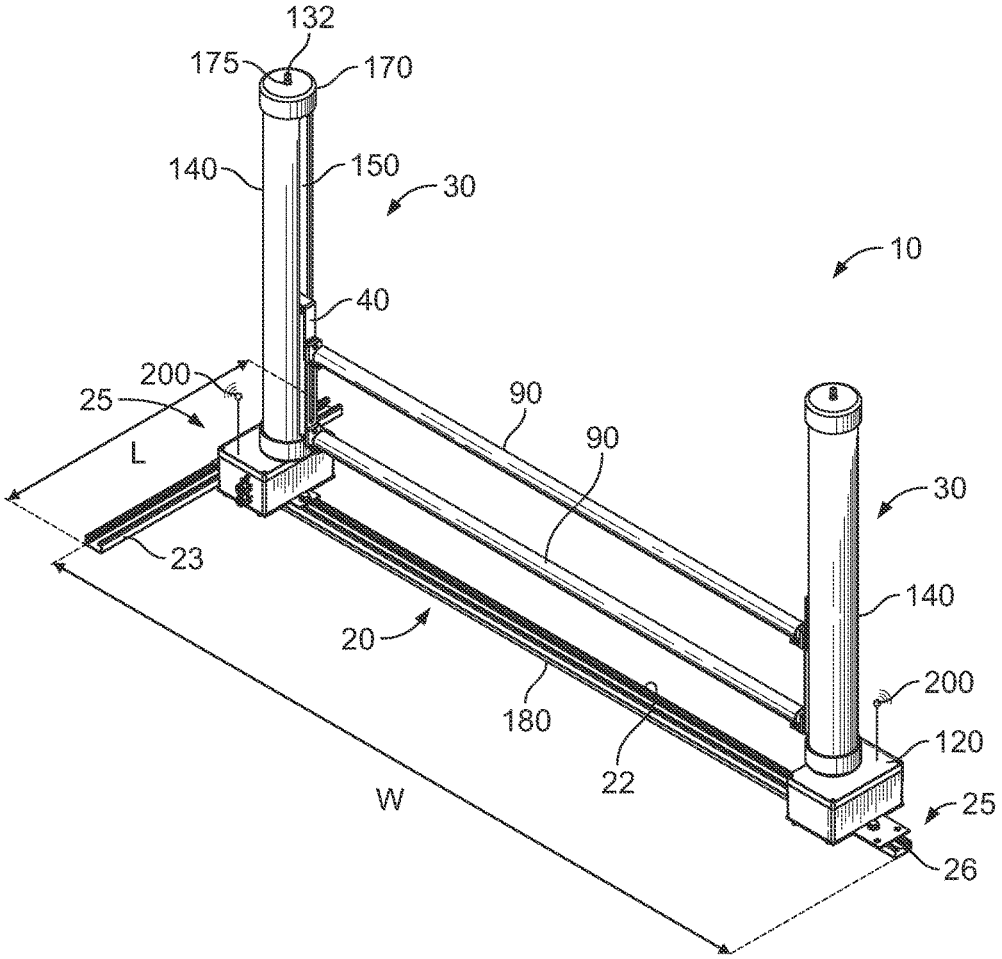
FIG. 1 is a perspective view of the invention.
Figure 2:
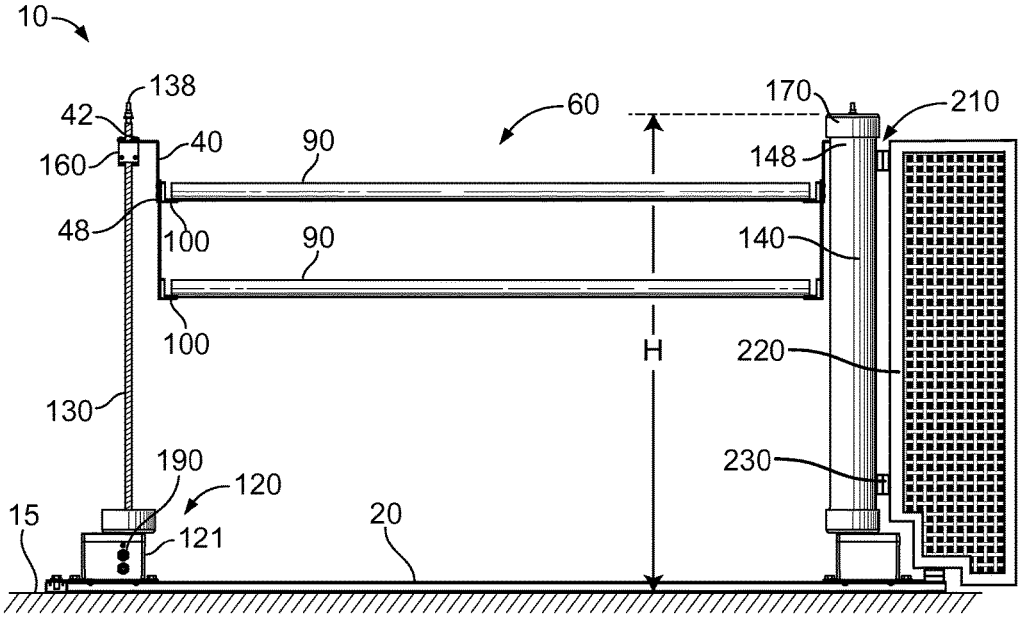
FIG. 2 is a front elevational view of the invention, a shaft enclosure of a left-most linear actuator omitted for clarity of illustration.
Figure 4:
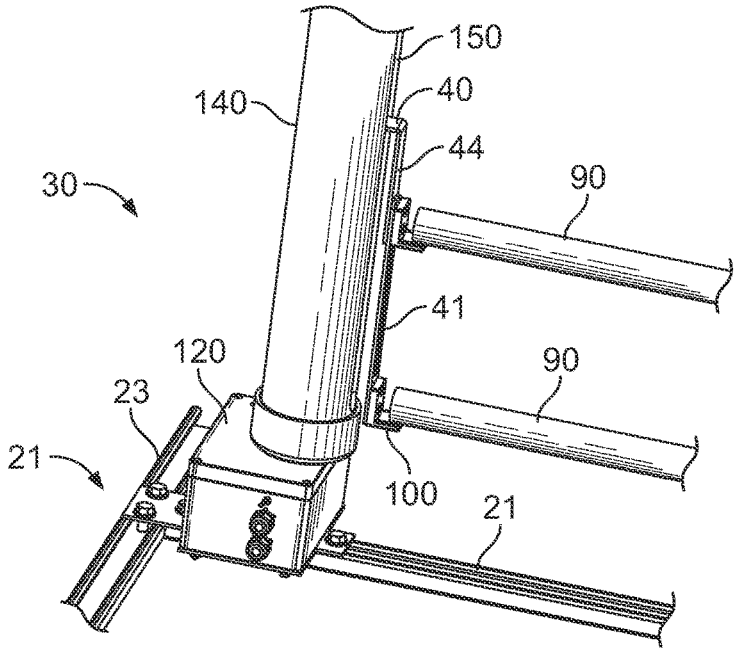
FIG. 4 is an enlarged perspective view of an embodiment wherein one of the linear actuators supporting two jump bars above a ground surface.

FIGS. 1 and 2 illustrate an adjustable vault apparatus 10 for use on a ground surface 15, such as an animal competition track or the like. A base 20 has a width W and a length L for resting on the ground surface 15 in a substantially horizontal orientation. The base 20 is stable on the ground surface 15 and not prone to tipping, even if knocked by a running animal for example, since the center of gravity of the apparatus is substantially towards the ground surface 15 and W and L are sufficiently large (at least 24 inches each, for example). Preferably the base 20 is comprised of a width spanning member 22 having opposing ends 26, and a length spanning member 23 that are mutually fixed together to form a T-shaped base 21 (FIG. 4). In one embodiment, the base 20 is readily collapsible for facilitating breakdown and setup of the vault apparatus 10, and storage and transportation thereof.

A pair of linear actuators 30 are mounted in a substantially vertical orientation with the base 20 at opposing sides 25 thereof, and in the embodiment having the width spanning member 22, at the opposing ends 26 thereof. In one embodiment, each linear actuator 30 is adjustably and selectively fixed along the width spanning member 22 so as to set the width W between the linear actuators 30 as desired so as to support jump bars 90 of varying lengths therebetween.

Each linear actuator 30 is adapted to move a bar support 40 thereof vertically between a lowered position 50 (FIG. 5) and a raised position 60 (FIG. 2). The bar supports 40 are mutually opposing, facing each other across the width W of the base 20. Each bar support 40 is adapted to support one end of an elongated jump bar 90 at a bar trough 100 thereof, by gravity. As such, a slight bump by an animal (not shown) attempting to jump over the jump bar 90 causes the jump bar 90 to become dislodged from the bar trough 100, indicating a failed jump by the animal. Each jump bar 90 is preferably elongated, linear, and light in weight, as required by animal competition rules or the like. Further, each jump bar 90 may be made from an elastomeric or resilient material.

Figure 5:
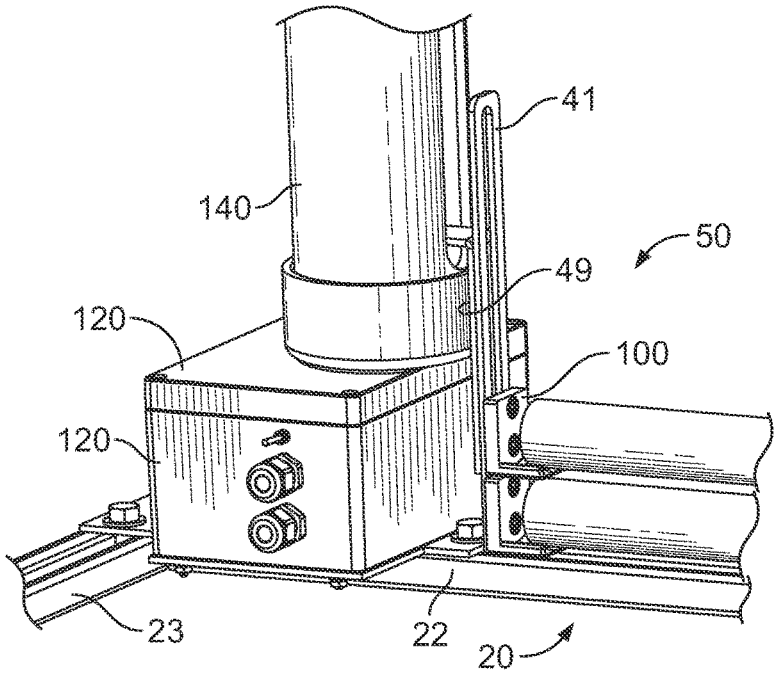
FIG. 5 is an enlarged perspective view of FIG. 4 but with the linear actuators and a bar support in a lowered position.

In one embodiment, each bar support 40 is adapted to support the ends of two jump bars 90 in parallel, each at two different heights above the ground surface (FIG. 4). In such an embodiment, preferably the bar support 40 is comprised of a lower bar support 41 slidably engaged with an upper bar support 49, such that at the lowered position 50 the lower bar support 41 slides up and is sandwiched between the upper bar support 49 and the base 20 (FIG. 5).

Figure 3:
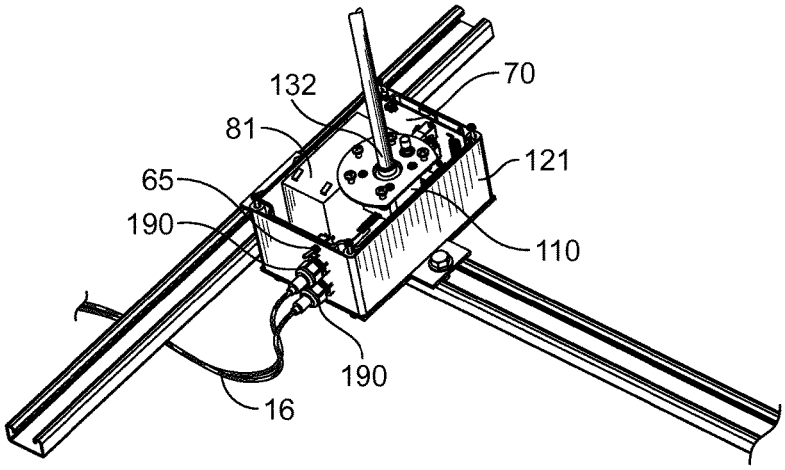
FIG. 3 is a partial perspective view of a motor enclosure of one of the linear actuators of the invention, a shaft enclosure and motor enclosure lid removed for clarity of illustration.

Each linear actuator 30 moves the bar support 40 in accordance to a control circuit 70 electrically connected with each linear actuator 30 and a power source 80. The power source 80 may be an external source such as an AC adapter or line voltage (not shown), or a battery 81 (FIG. 3), for example. A control signal received by the control circuit 70 causes the control circuit 70 to actuate each linear actuator 30 to either raise or lower in unison each bar support 40 and the at least one jump bar 90, the at least one jump bar 90 preferably remaining level while being moved either up or down.

Preferably each linear actuator 30 includes a motor 110 (FIG. 3) enclosed in a motor enclosure 120 and connected with a lower end 132 of a threaded shaft 130 that extends upwardly through a shaft enclosure 140. The shaft enclosure 140 includes a longitudinal slot 150 traversed by the bar support 40. A proximal end 42 of the bar support 40 includes a threaded portion 160 rotationally engaged with the threaded shaft 130. A distal portion 48 of the bar support 40 terminates at the bar trough 100. The longitudinal slot 150 rotationally fixes the bar support 40 within the linear actuator 30, while allowing the bar support 40 to be raised or lowered in accordance with the direction that the motor 110 spins the threaded shaft 130. A top end 148 of the shaft enclosure 140 may include a shaft cap 170 having a central aperture 175 through which an upper end 138 of the threaded shaft 130 is rotationally captured, thereby maintaining the position of the rotational axis of the threaded shaft 130 within the shaft enclosure 140. Preferably each motor enclosure 120 is made from a rigid plastic or metal material and sealed against water ingress.

In one embodiment, a first motor enclosure 121 includes a battery 81 as the power source 80, and the control circuit 70. In such an embodiment, the control circuit 70 of the first motor enclosure 121 drives the motors 110 of both the first motor enclosure 121 and a second motor enclosure 122 (FIG. 2). As such, the base 20 includes at least one electrical conductor 180 for powering the motor 110 of the second motor enclosure 122, the circuit being completed through the base 20 that is metallic and electrically conductive. Alternately, at least two electrical conductors 180 may be included between the motor enclosures 120 when the base 20 is non-conductive, such as when made from a rigid or non-flexible plastic material for example. Preferably each conductor 180 includes at least one releasable connector 190 (not shown with conductors 180) so that if the vault apparatus 10 is physically impacted, the base 20, motor enclosures 120, and each conductor 180 will all separate so as not to damage the at least one conductor 180.

The first motor enclosure 121 may include a pair of the control connectors 190, whereby an external control line 16 may be connected with each of the control connectors 190 to direct the circuit 70 to power each motor 110 to either raise or lower the at least one bar support 90. In an alternate embodiment, the control circuit 70 of at least the first motor enclosure 121 includes a wireless receiver 200, whereby a wireless control signal may be received by the wireless receiver 200 and conveyed to the circuit 70 for powering each linear actuator 30 to either raise or lower the at least one bar support 90.

In an alternate embodiment of the invention, each motor enclosure includes its own battery 81 or other power source 80, and its own circuit 70, whereby each linear actuator operates independently to receive the control signal, either through the wired control line 16 or wirelessly, to power the linear actuator 30 to either raise or lower the at least one bar support 90.

In one embodiment, each linear actuator 30 may include a wing mount 210 (FIG. 2) opposite the bar support 40 for securing a wing 220 laterally away from the jump bar 90. Such a wing mount 210 may be a pair of magnets 230, for example, or other mechanical support that is readily collapsible.

While a particular form of the invention has been illustrated and described, it will be apparent that various modifications can be made without departing from the spirit and scope of the invention. For example, the linear actuators 30 herein are described as being rotational threaded shafts, but other types of linear actuators 30 could be utilized as well, such as pneumatic or hydraulic linear actuators 30. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An adjustable vault apparatus for use on a ground surface, comprising:

a base having a width and a length for resting on the ground surface in a substantially horizontal orientation;

a pair of linear actuators mounted in a substantially vertical orientation with the base at opposing sides thereof, each linear actuator adapted to move each of a bar support of an upper set of bar supports thereof vertically between a lowered and a raised position in accordance to a control circuit electrically connected with each linear actuator and a power source, each bar support facing the other and adapted to support an elongated jump bar at a bar trough thereof by gravity therebetween;

the control circuit adapted to receive an adjustment signal for either raising or lowering the at least one jump bar;

a lower set of bar supports slidably engaged with the upper set of bar supports, wherein movement of the lower set of bar supports is caused by movement of the upper set of bar supports.

2. The adjustable vault apparatus of claim 1 wherein each linear actuator includes a motor enclosed in a motor enclosure and connected with a lower end of a threaded shaft that extends upwardly through a shaft enclosure, the shaft enclosure including a longitudinal slot traversed by the bar support, a proximal end of the bar support including a threaded portion rotationally engaged with the threaded shaft, and a distal portion terminating at the bar trough, the longitudinal slot rotationally fixing the bar support within the linear actuator.

3. The adjustable vault apparatus of claim 2 wherein a top end of the shaft enclosure includes a shaft cap having an aperture through which an upper end of the threaded shaft is rotationally captured.

4. The adjustable vault apparatus of claim 1 wherein a first of the motor enclosures further includes a battery power source and the control circuit, and wherein the base includes at least one electrical conductor for powering the motor of a second motor enclosure.

5. The adjustable vault apparatus of claim 4 wherein the base is metallic and electrically couples each motor enclosure as electrical ground, and wherein the at least one electrical conductor is exactly one electrical conductor.

6. The adjustable vault apparatus of claim 4 wherein the base is made of a non-flexible plastic material and wherein the at least one electrical conductor is at least a pair of electrical conductors.

7. The adjustable vault apparatus of claim 1 wherein each motor enclosure further includes a battery power source and the control circuit.

8. The adjustable vault apparatus of claim 4 wherein the control circuit of a first of the motor enclosures includes a pair of control connectors, whereby a control line may be connected with each of the control connectors to direct the circuit to power each motor to either raise or lower the bar support.

9. The adjustable vault apparatus of claim 4 wherein the control circuit of the first of the motor enclosures includes a wireless receiver, whereby a wireless control signal received by the wireless receiver directs the control circuit to power each motor to either raise or lower the bar support.

10. The adjustable vault apparatus of claim 7 wherein each motor enclosure includes a pair of control connectors electrically coupled with the control circuit, whereby a control line may be connected with each of the control connectors of each motor enclosure to direct each circuit to power the motor to either raise or lower the bar support.

11. The adjustable vault apparatus of claim 7 wherein the control circuit of each motor enclosure includes a wireless receiver, whereby a wireless control signal received by each wireless receiver directs the control circuit to power the motor to either raise or lower the bar support.

12. The adjustable vault apparatus of claim 1 wherein the base is comprised of a width spanning member and a length spanning member to form a T-shaped base, each linear actuator fixed proximate opposing ends of the width spanning member.

13. The adjustable vault apparatus of claim 12 wherein each linear actuator is adjustably fixed along the width spanning member so as to support jump bars of varying lengths.

14. The adjustable vault apparatus of claim 1 wherein the upper set and lower set of bar supports are adapted to support two jump bars in parallel, each at two different heights above the ground surface.

15. The adjustable vault apparatus of claim 14 wherein at the lowered position the lower set of bar supports is sandwiched between the base and the upper set of bar supports.

16. An adjustable vault apparatus for use on a ground surface, comprising:

a base having a width and a length for resting on the ground surface in a substantially horizontal orientation;

a pair of linear actuators mounted in a substantially vertical orientation with the base at opposing sides thereof, each linear actuator adapted to move each of a bar support of an upper set of bar supports thereof vertically between a lowered and a raised position in accordance to a control circuit electrically connected with each linear actuator and a power source, each bar support facing the other and adapted to support an elongated jump bar at a bar trough thereof by gravity therebetween;

the control circuit adapted to receive an adjustment signal for either raising or lowering the at least one jump bar, wherein the base is comprised of a width spanning member, spanning between the pair of linear actuators, and a length spanning member to form a T-shaped base, each linear actuator fixed proximate opposing ends of the width spanning member;

each linear actuator is adjustably fixed along the width spanning member so as to support jump bars of varying lengths; and movement of a lower set of bar supports is caused by movement of the upper set of bar supports.

17. The adjustable vault apparatus of claim 16, wherein the upper set of bar supports is movable by each of the pair of linear actuators, and the lower set of bar supports is slidably engaged with the upper set of bar supports.

18. The adjustable vault apparatus of claim 16, wherein each linear actuator includes a motor enclosed in a motor enclosure and connected with a lower end of a threaded shaft that extends upwardly through a shaft enclosure, the shaft enclosure including a longitudinal slot traversed by the bar support, a proximal end of the bar support including a threaded portion rotationally engaged with the threaded shaft, and a distal portion terminating at the bar trough, the longitudinal slot rotationally fixing the bar support within the linear actuator.

19. The adjustable vault apparatus of claim 1, further comprising wing mounts disposed on each of the linear actuators for removably attaching wings thereto.

20. The adjustable vault apparatus of claim 1, further comprising wing mounts disposed on each of the linear actuators for removably attaching wings thereto.

* * * * *